US008927848B2

(12) United States Patent
Kaneko

(10) Patent No.: US 8,927,848 B2
(45) Date of Patent: Jan. 6, 2015

(54) KEYBOARD CIRCUIT AND METHOD FOR DETECTING KEYBOARD CIRCUIT

(71) Applicant: Casio Computer Co., Ltd., Shibuya-ku, Tokyo (JP)

(72) Inventor: Yoji Kaneko, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/919,946

(22) Filed: Jun. 17, 2013

(65) Prior Publication Data

US 2014/0000444 A1 Jan. 2, 2014

(30) Foreign Application Priority Data

Jun. 27, 2012 (JP) ..... 2012-144582

(51) Int. Cl.
*G10H 1/34* (2006.01)
*G10H 1/18* (2006.01)

(52) U.S. Cl.
CPC ..... *G10H 1/182* (2013.01); *G10H 1/34* (2013.01); *G10H 1/344* (2013.01); *G10H 2220/285* (2013.01)
USPC ..... 84/720

(58) Field of Classification Search
USPC ..... 84/644, 745, 720
See application file for complete search history.

(56) References Cited

U.S. PATENT DOCUMENTS

| | | | | |
|---|---|---|---|---|
| 4,339,978 | A * | 7/1982 | Imamura | 84/610 |
| 4,686,880 | A * | 8/1987 | Salani et al. | 84/644 |
| 6,765,142 | B2 * | 7/2004 | Sakurada et al. | 84/719 |
| 7,319,187 | B2 * | 1/2008 | Sunako | 84/662 |
| 8,481,841 | B2 * | 7/2013 | Shimoda | 84/744 |
| 2008/0307944 | A1 * | 12/2008 | Watanabe | 84/433 |
| 2011/0239846 | A1 * | 10/2011 | Shimoda | 84/687 |
| 2013/0074684 | A1 * | 3/2013 | Iwase et al. | 84/745 |
| 2013/0319210 | A1 * | 12/2013 | Yoshida | 84/745 |

FOREIGN PATENT DOCUMENTS

| | | | |
|---|---|---|---|
| JP | 2011-013259 | A | 1/2011 |
| JP | 4888842 | B2 | 2/2012 |

* cited by examiner

*Primary Examiner* — Jeffrey Donels
(74) *Attorney, Agent, or Firm* — Holtz, Holtz, Goodman & Chick PC

(57) ABSTRACT

A keyboard circuit (15) of an electric music instrument includes contact transistors (TRk) having at least three terminals as input/output terminals for state detection for each of a plurality of contacts (14*a*, 14*b*, and 14*c*); and wiring units to the contact transistors (TRk) and the contacts (14*a*, 14*b*, and 14*c*). A selector (Sm) and the wiring unit for each of the plurality of contacts (14*a*, 14*b*, and 14*c*) are arranged to be divided into a plurality of layers in three dimensions. Then, the keyboard circuit (15) detects ON/OFF states for each of the contacts (14*a*, 14*b*, and 14*c*) for which the ON/OFF states change in response to a key-pressing operation for each of a plurality of keys (12) and for which at least one is provided to each of the plurality of keys (12).

8 Claims, 10 Drawing Sheets

FIG. 7

| KE[3:0] | KB[2:0] | KI[0] | KI[1] | KI[2] | KI[3] | KI[4] | KI[5] | KI[6] | KI[7] | KI[8] | KI[9] | KI[10] | KI[11] | KI[12] | KI[13] | KI[14] | KI[15] | KI[16] | KI[17] | KI[18] | KI[19] | KI[20] | KI[21] |
|---|---|---|---|---|---|---|---|---|---|---|---|---|---|---|---|---|---|---|---|---|---|---|---|
| 0 | 0 | F00 | F04 | F08 | F12 | F16 | F20 | F24 | F28 | F32 | F36 | F40 | F44 | F48 | F52 | F56 | F60 | F64 | F68 | F72 | F76 | F80 | F84 |
| | 1 | S00 | S04 | S08 | S12 | S16 | S20 | S24 | S28 | S32 | S36 | S40 | S44 | S48 | S52 | S56 | S60 | S64 | S68 | S72 | S76 | S80 | S84 |
| | 2 | T00 | T04 | T08 | T12 | T16 | T20 | T24 | T28 | T32 | T36 | T40 | T44 | T48 | T52 | T56 | T60 | T64 | T68 | T72 | T76 | T80 | T84 |
| 1 | 0 | F01 | F05 | F09 | F13 | F17 | F21 | F25 | F29 | F33 | F37 | F41 | F45 | F49 | F53 | F57 | F61 | F65 | F69 | F73 | F77 | F81 | F85 |
| | 1 | S01 | S05 | S09 | S13 | S17 | S21 | S25 | S29 | S33 | S37 | S41 | S45 | S49 | S53 | S57 | S61 | S65 | S69 | S73 | S77 | S81 | S85 |
| | 2 | T01 | T05 | T09 | T13 | T17 | T21 | T25 | T29 | T33 | T37 | T41 | T45 | T49 | T53 | T57 | T61 | T65 | T69 | T73 | T77 | T81 | T85 |
| 2 | 0 | F02 | F06 | F10 | F14 | F18 | F22 | F26 | F30 | F34 | F38 | F42 | F46 | F50 | F54 | F58 | F62 | F66 | F70 | F74 | F78 | F82 | F86 |
| | 1 | S02 | S06 | S10 | S14 | S18 | S22 | S26 | S30 | S34 | S38 | S42 | S46 | S50 | S54 | S58 | S62 | S66 | S70 | S74 | S78 | S82 | S86 |
| | 2 | T02 | T06 | T10 | T14 | T18 | T22 | T26 | T30 | T34 | T38 | T42 | T46 | T50 | T54 | T58 | T62 | T66 | T70 | T74 | T78 | T82 | T86 |
| 3 | 0 | F03 | F07 | F11 | F15 | F19 | F23 | F27 | F31 | F35 | F39 | F43 | F47 | F51 | F55 | F59 | F63 | F67 | F71 | F75 | F79 | F83 | F87 |
| | 1 | S03 | S07 | S11 | S15 | S19 | S23 | S27 | S31 | S35 | S39 | S43 | S47 | S51 | S55 | S59 | S63 | S67 | S71 | S75 | S79 | S83 | S87 |
| | 2 | T03 | T07 | T11 | T15 | T19 | T23 | T27 | T31 | T35 | T39 | T43 | T47 | T51 | T55 | T59 | T63 | T67 | T71 | T75 | T79 | T83 | T87 |

FIG. 8

| KC[7:0] | FI[0] | FI[1] | FI[2] | FI[3] | FI[4] | FI[5] | FI[6] | FI[7] | FI[8] | FI[9] | FI[10] |
|---|---|---|---|---|---|---|---|---|---|---|---|
| 0 | F00 | F01 | F02 | F03 | F04 | F05 | F06 | F07 | F08 | F09 | F10 |
| 1 | F11 | F12 | F13 | F14 | F15 | F16 | F17 | F18 | F19 | F20 | F21 |
| 2 | F22 | F23 | F24 | F25 | F26 | F27 | F28 | F29 | F30 | F31 | F32 |
| 3 | F33 | F34 | F35 | F36 | F37 | F38 | F39 | F40 | F41 | F42 | F43 |
| 4 | F44 | F45 | F46 | F47 | F48 | F49 | F50 | F51 | F52 | F53 | F54 |
| 5 | F55 | F56 | F57 | F58 | F59 | F60 | F61 | F62 | F63 | F64 | F65 |
| 6 | F66 | F67 | F68 | F69 | F70 | F71 | F72 | F73 | F74 | F75 | F76 |
| 7 | F77 | F78 | F79 | F80 | F81 | F82 | F83 | F84 | F85 | F86 | F87 |

| KC[7:0] | SI[0] | SI[1] | SI[2] | SI[3] | SI[4] | SI[5] | SI[6] | SI[7] | SI[8] | SI[9] | SI[10] |
|---|---|---|---|---|---|---|---|---|---|---|---|
| 0 | S00 | S01 | S02 | S03 | S04 | S05 | S06 | S07 | S08 | S09 | S10 |
| 1 | S11 | S12 | S13 | S14 | S15 | S16 | S17 | S18 | S19 | S20 | S21 |
| 2 | S22 | S23 | S24 | S25 | S26 | S27 | S28 | S29 | S30 | S31 | S32 |
| 3 | S33 | S34 | S35 | S36 | S37 | S38 | S39 | S40 | S41 | S42 | S43 |
| 4 | S44 | S45 | S46 | S47 | S48 | S49 | S50 | S51 | S52 | S53 | S54 |
| 5 | S55 | S56 | S57 | S58 | S59 | S60 | S61 | S62 | S63 | S64 | S65 |
| 6 | S66 | S67 | S68 | S69 | S70 | S71 | S72 | S73 | S74 | S75 | S76 |
| 7 | S77 | S78 | S79 | S80 | S81 | S82 | S83 | S84 | S85 | S86 | S87 |

| KC[7:0] | TI[0] | TI[1] | TI[2] | TI[3] | TI[4] | TI[5] | TI[6] | TI[7] | TI[8] | TI[9] | TI[10] |
|---|---|---|---|---|---|---|---|---|---|---|---|
| 0 | T00 | T01 | T02 | T03 | T04 | T05 | T06 | T07 | T08 | T09 | T10 |
| 1 | T11 | T12 | T13 | T14 | T15 | T16 | T17 | T18 | T19 | T20 | T21 |
| 2 | T22 | T23 | T24 | T25 | T26 | T27 | T28 | T29 | T30 | T31 | T32 |
| 3 | T33 | T34 | T35 | T36 | T37 | T38 | T39 | T40 | T41 | T42 | T43 |
| 4 | T44 | T45 | T46 | T47 | T48 | T49 | T50 | T51 | T52 | T53 | T54 |
| 5 | T55 | T56 | T57 | T58 | T59 | T60 | T61 | T62 | T63 | T64 | T65 |
| 6 | T66 | T67 | T68 | T69 | T70 | T71 | T72 | T73 | T74 | T75 | T76 |
| 7 | T77 | T78 | T79 | T80 | T81 | T82 | T83 | T84 | T85 | T86 | T87 |

KEYBOARD CIRCUIT AND METHOD FOR DETECTING KEYBOARD CIRCUIT

This application is based upon and claims the benefit of priority from the prior Japanese Patent Application No. 2012-144582, filed Jun. 27, 2012, and the entire contents of which are incorporated herein by reference.

BACKGROUND OF THE INVENTION

1. Field of the Invention

The present invention relates to a keyboard circuit and a method for detecting a keyboard circuit.

2. Related Art

Conventionally, for electric music instruments such as an electric piano, an electric organ, and the like, a switch matrix is configured which arranges a plurality of switches in a matrix form that turn ON/OFF according to an operation on a keyboard. The electric music instruments detect an operation on a keyboard by scanning this switch matrix periodically (for example, Japanese Unexamined Patent Application, Publication No. 2011-13259).

More specifically, among such electric music instruments, for an electric piano having 88 keys, two switches having different ON positions are arranged for each key in order to detect the intensity of a musical performance. Then, the electric piano measures the difference in the time at which these switches turn ON, and measures key-pressing speed on the keyboard based on the measured values. Therefore, 176 pieces of switch matrices (88 keys×2 switches) are arranged for the electric piano.

However, the number of wires on a substrate to which such conventional switch matrices are mounted (hereinafter, referred to as a "keyboard switch substrate") approaches the limit of the capacity thereof. Therefore, a keyboard switch substrate has been desired that can significantly reduce the number of wires in a keyboard switch substrate compared to conventional ones and thus allows for wiring on a single-sided substrate. This matter is described in detail in the following with reference to FIGS. 9 and 10.

FIG. 9 is an equivalent circuit diagram illustrating the configuration of a conventional switch matrix.

As illustrated in FIG. 9, in the conventional switch matrix, eight lines of scan output signals KC0 to KC7 are arranged to cross 22 lines of input signals KI0 to KI21. A diode is connected with a switch in series near the intersection between the respective wires of a scan output signal KCi (i is any of integer values 0 to 7) and an input signal KIj (j is any of integer values 0 to 21). The diode is provided with the purpose of preventing signals from looping when a plurality of keys is simultaneously pressed.

FIG. 10 shows timing charts illustrating an outline of an operation of a conventional switch matrix.

FIG. 10 illustrates timing charts of signals flowing to each of the scan output signals KC0 to KC7 and a pre-charge signal PRC in order from the top.

In each timing chart, the horizontal axis represents time and the vertical axis represents signal level. It should be noted that explanations are provided in which each signal is a pulse signal and a signal level is explained as taking the two values of a high level ("H level") and a low level ("L level") in the following.

As illustrated in FIG. 10, in the conventional switch matrix, each output of the 8 scan output signals KC0 to KC7 is sequentially set to be L level in this order.

Then, with the scan output signal KCi being set to be L level, the ON/OFF states of switches connected to each wire of the scan output signal KCi and the respective wires of the 22 input signals KI0 to KI21 are detected based on each output state of the 22 input signals KI0 to KI21.

In other words, since 220N/OFF states of the switches per one scan output signal KCi are detected, 176 (8×22) ON/OFF states of the switches are detected in the conventional switch matrix having 8 scan output signals KC0 to KC7.

It should be noted that the pre-charge signal PRC is a control signal for H level that is supplied instantly from a buffer at the changing point. It is possible to correct waveform rounding and to perform high-speed scanning by supplying the pre-charge signal PRC.

In this way, on the substrate for detecting switches on which the conventional switch matrices are mounted, the wires for the 8 scan output signals KC0 to KC7 and wires for the 22 input signals KI0 to KI21, amounting to 30, are required.

However, with the structural constraints of the keyboard, it is necessary for the width of the substrate for detecting keyboard switches to be kept within a predetermined width, and the current situation is that wiring 30 signal lines almost approaches the limit of the capacity thereof.

Furthermore, the conventional switch matrix illustrated in FIGS. 9 and 10 is configured in an electric piano having two contacts (switches) for one key, i.e. an electric piano having 176 switches (88 keys×2 switches/key).

However, an electric piano having three contacts (switches) per one key, i.e. an electric piano having 264 switches (88 keys×three switches/key) has been recently produced. The conventional switch matrix illustrated in FIGS. 9 and 10 cannot be applied as it is to such an electric piano, and it is necessary to configure a switch matrix that can detect 264 switches. In this case, even if trying to realize a switch matrix with a structure similar to that of FIG. 9, a total of 41 wires for the 8 scan output signals and 33 input signals are required, a result of which the realization is extremely difficult due to the structural constraints of the keyboard as mentioned above.

In this regard, by adopting a substrate with double-sided through-holes as the substrate for detecting keyboard switches, the arrangement of 41 wires in itself becomes possible, even if the minimum width required from the structural constraint of the keyboard; however, this leads to a significant increase in cost compared to existing single-sided substrates.

Alternatively, it has also been considered to configure by connecting a plurality of substrates of the structure of FIG. 9 as a substrate for detecting keyboard switches. In this case, although the ratio of cost increase is lower than a case of adopting a double-sided through-hole type substrate, it would not change the fact of being a considerable cost increase compared to the single substrate in FIG. 9.

SUMMARY OF THE INVENTION

The present invention has been devised in view of such problems, and it is an object of the present invention to enable wiring that can significantly reduce the number of wires in a keyboard switch substrate compared to conventional ones, even for a single-sided substrate.

In order to achieve the abovementioned object, a keyboard circuit according to an aspect of the present invention includes: contact units that are provided so as to correspond to a plurality of keys, respectively, and have ON/OFF states that change in response to a key-pressing/key-releasing operation to the plurality of keys; elements that are provided for each of the plurality of keys, and have at least three input/output terminals, wherein the contact units are connected to any one of the input/output terminals; and a wiring unit that outputs signals indicating the ON/OFF states of the respective contact units by supplying a switch signal to a remaining one of the input/output terminals of the respective elements, supplying a control signal to another remaining one of the input/output terminals, and supplying to the contact units the switch signal supplied in a time-division manner by way of the control signal.

Furthermore, a method for detecting a keyboard circuit according to an aspect of the present invention is a method for detecting a keyboard circuit including: contact units that are provided so as to correspond to a plurality of keys, respectively, and have ON/OFF states that change in response to a key-pressing/key-releasing operation to the plurality of keys; and elements that are provided for each of the plurality of keys and have at least three input/output terminals, wherein the contact units are connected to any one of the input/output terminals of each of the elements, the method including the steps of: inputting a switch signal to a remaining one of the input/output terminals of each of the elements; inputting a control signal to another remaining one of the input/output terminals; and outputting a signal indicating the ON/OFF states of the respective contact units by supplying to the contact units the switch signal inputted in a time-division manner by way of the control signal.

BRIEF DESCRIPTION OF THE DRAWINGS

FIG. 7 is a view illustrating corresponding relationships between states of switches as a target for detection within a three-dimensional switch matrix (3D matrix) and a scan output signal KE[3:0], a control signal KB[2:0], and an input signal KI[21:0], as illustrated in FIG. 6;

FIG. 8 is a view illustrating relationships of states of switches as a target for detection within a two dimensional switch matrix (2D_matrix) specified based on a scan output signal KC[7:0] and input signals FI[10:0], SI[10:0], and TI[10:0], as illustrated in FIG. 6;

DETAILED DESCRIPTION OF THE INVENTION

The embodiments of the present invention are described with reference to the drawings in the following.

Figure 1:
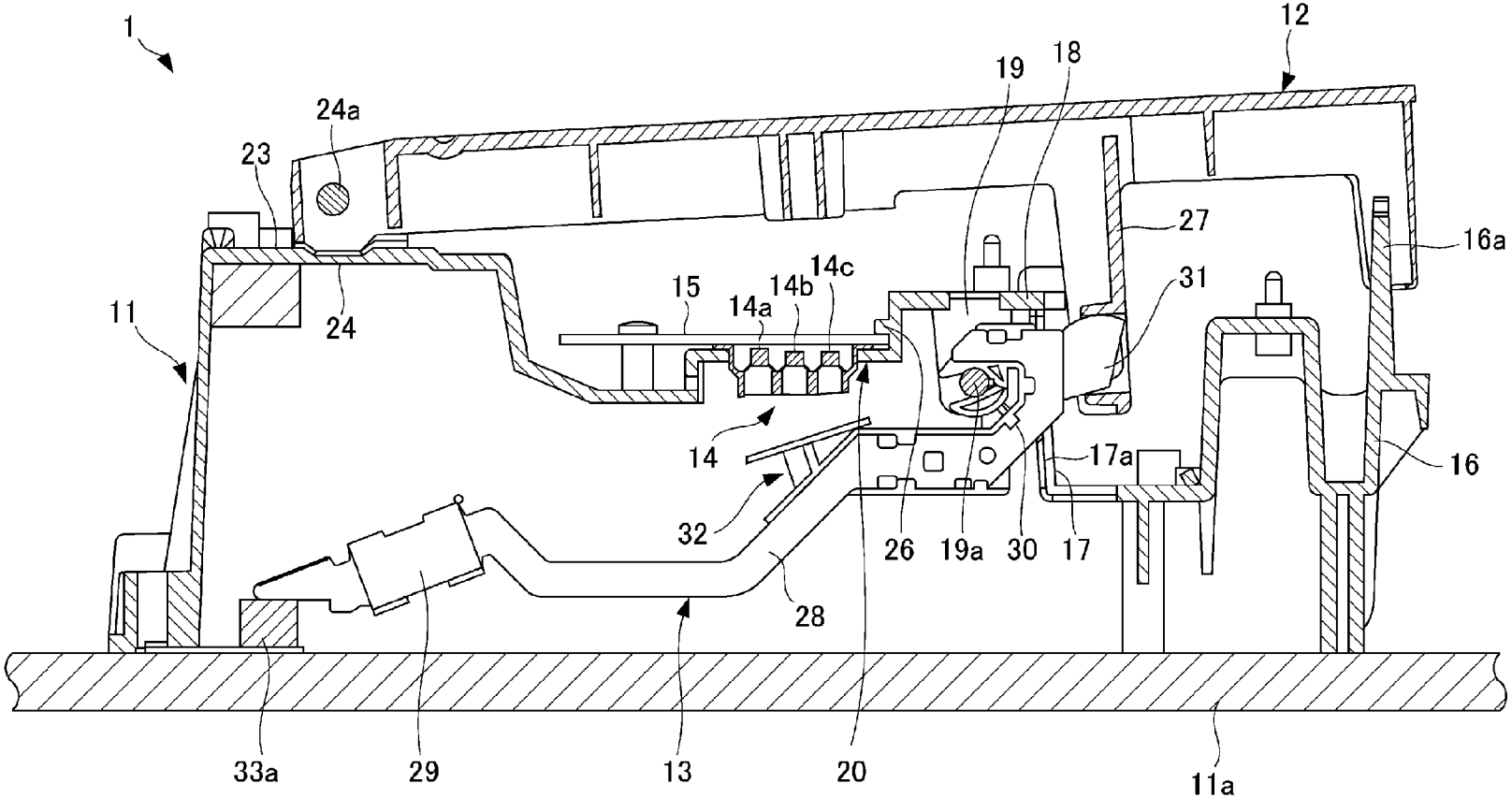
FIG. 1 is a cross-sectional view of a keyboard device including a keyboard circuit of an electric music instrument according to an embodiment of the present invention.

FIG. 1 is a cross-sectional view of a keyboard device including a keyboard circuit of an electric music instrument according to an embodiment of the present invention.

The keyboard device 1 of the electric music instrument is configured as the keyboard device 1 of an electric piano, for example.

As illustrated in FIG. 1, the keyboard device 1 of the electric music instrument includes a keyboard chassis 11, a plurality of keys 12 (white keys and black keys; however, explanations are provided here using one white key in the embodiment), a plurality of hammer members 13 (however, explanations are provided here using only one hammer member in the embodiment), a switch 14, and a keyboard circuit 15.

A side on which the key 12 is provided relative to the hammer member 13 is referred to as "upper side" hereinafter. On the other hand, a side on which the hammer member 13 is provided relative to the key 12 is referred to as "lower side" hereinafter. Furthermore, the key 12 pivots around a specific point provided at the keyboard chassis 11. A side on which the center of pivoting is located on this key 12 is referred to as "rear side" hereinafter. On the other hand, the other side on which the center of pivoting is located on this key 12 is referred to as "front side" hereinafter.

The keyboard chassis 11 is made of synthetic resin and constitutes a housing of the keyboard device 1.

The keyboard chassis 11 is disposed on a bottom plate 11*a* of a main body (not illustrated) of the electric music instrument, and a front leg portion 16 is formed to protrude to the upper side from the bottom plate 11*a* at the front side of the keyboard chassis 11. At the upper side of the front leg portion 16, a key guide portion 16*a* is provided to prevent horizontal displacement of the key 12. As illustrated in FIG. 1, at the rear side of the front leg portion 16, an upright portion 17 is formed to be located a slightly lower than the key guide portion 16*a*.

The opening portion 17*a* for inserting a hammer into which the front side of the hammer member 13 described later is inserted so as to move in the vertical direction is formed in the upright portion 17. At the upper side of the upright portion 17, a hammer placing portion 18 is formed in substantially a horizontal direction toward the rear side. At the lower portion of this hammer placing portion 18, a hammer support portion 19 for supporting the hammer member 13 is provided such that it protrudes downwards. A support shaft 19*a* is provided which supports the hammer member 13 to be pivotable at this hammer support member 19.

Furthermore, a substrate mounting portion 20 is formed at the rear side of the hammer placing portion 18. To this substrate mounting portion 20 are provided the keyboard circuit 15 having the switch 14 configured by a plurality of contacts 14*a*, 14*b*, and 14*c*.

The plurality of keys 12 is arranged so as to be pivotable in the vertical direction on the keyboard chassis 11.

At the rear side of the keyboard chassis 11, i.e. at the rear side of the substrate mounting portion 20, a key placing portion 23 is formed to be slightly higher than the hammer placing unit 18. The key support portion 24 is formed at the upper side of this key placing portion 23. At the key support portion 24, a support shaft 24*a* is provided which supports the rear side of the key 12 so as to be pivotable in the vertical direction.

At a part of the key 12 located at the front side of the key 12, a hammer guide portion 27 is formed such that it protrudes below the key 12. This hammer guide portion 27 is configured so as to slidably insert a key abutting portion 31 located at the front side of the hammer member 13 so as to displace the key abutting portion 31 thus inserted in the vertical direction in response to the key-pressing operation to the key 12.

The hammer members 13 are respectively arranged so as to apply action loading to a plurality of the keys 12, respectively. The hammer member 13 includes: a hammer main body 28; a weight portion 29 provided at the rear side of this hammer main body 28; a pivot support portion 30 made of synthetic resin that is provided at the upper front side of the hammer main body 28 so as to be the center of pivoting of the hammer main body 28; the key abutting portion 31 provided at the front side of the hammer main body 28; and a switch pressing portion 32 for pressing three contacts 14*a*, 14*b*, and 14*c* provided on the keyboard circuit 15 at substantially the intermediate location in the rear/front direction of the hammer main body 28. The three contacts 14*a*, 14*b*, and 14*c* respectively perform an ON operation in accordance with the plurality of keys 12.

The hammer member 13 causes the key abutting portion 31 of the hammer main body 28 to be inserted into the opening 17*a* of the upright portion 17 from the lower side of the keyboard chassis 11 so as to protrude toward the front side of the hammer placing portion 18. In this state, the hammer main body 28 is configured so as to pivot around the support shaft 19*a* of the hammer support portion 19 in the vertical direction by pivotably mounting the pivot support unit 30 of the hammer main body 28 to the support shaft 19*a* of the hammer support portion 19 provided at the hammer placing portion 18.

Furthermore, the hammer member 13 is configured such that, when the pivot support portion 30 of the hammer main body 28 is pivotably mounted to the support shaft 19*a* of the hammer support portion 19, the key abutting portion 31 provided at the tip of the front side of the hammer main body 28 is slidably inserted into the hammer guide portion 27 of the key 12. And in this state, the key abutting portion 31 displaces in the vertical direction along with the hammer guide portion 27 in response to the key-pressing operation of the key 12, so that the hammer member 13 causes the hammer main body 28 to pivot in the vertical direction around the support shaft 19*a* of the hammer support portion 19.

The switch 14 of the keyboard circuit 15, including the first contact 14*a*, the second contact 14*b*, and the third contact 14*c*, is provided at the lower side of the keyboard circuit 15 and protrudes toward the lower side of the substrate mounting portion 20 of the keyboard circuit 15. The switch 14 includes a rubber sheet provided at the lower surface of the keyboard circuit 15.

To this rubber sheet, a bulge portion in a dome shape is formed to protrude toward the lower side and the three contacts 14*a*, 14*b*, and 14*c* are provided in the bulge portion in the dome shape. It is configured so that the three contacts 14*a*, 14*b*, and 14*c* include three movable contacts provided in the bulge portion of the rubber sheet and the three fixed contacts provided on the surface of the lower side of the keyboard circuit 15 and the three movable contacts are configured so as to sequentially contact the three fixed contacts in a contactable and separable manner, respectively.

With such a configuration, it is configured so that, when the bulge portion of the rubber sheet protruding toward the lower side of the substrate mounting portion 20 provided at the lower portion of the keyboard circuit 15 is pressed from the lower side by the switch pressing portion 32 of the hammer member 13, the bulge portion is elastically deformed so that each of the movable contacts of the three contacts 14*a*, 14*b*, and 14*c* provided therein is sequentially contacted with each of the fixed contacts of the keyboard circuit 15, whereby the switch 14 outputs an ON signal according to the switching operation.

In other words, since this switch 14 is formed such that each of the distances between the fixed contacts and the movable contacts, which are the three contacts 14*a*, 14*b*, and 14*c*, differs, when the bulge portion of the rubber sheet is elastically deformed by the switch pressing portion of the hammer member 13, the second contact 14*b* turns ON after the first contact 14*a* turns ON and the third contact 14*c* turns ON after the second contact turns ON. In this way, it is configured so that the three contacts 14*a*, 14*b*, and 14*c* are switched to turn ON/OFF sequentially with time differences.

This switch 14 is thereby configured such that, by switching the three contacts 14*a*, 14*b*, and 14*c* to turn ON/OFF sequentially with time differences, key-on data instructing the start of sound generation to the audio source is acquired and a rotational speed of the hammer member 13 that is data relating to a key-pressing speed, i.e. initial-touch data for performing initial control on musical sound features such as volume, tone, etc. is acquired.

Next, a concept of a switch matrix in the keyboard circuit 15 of the present embodiment is explained.

Figure 2:
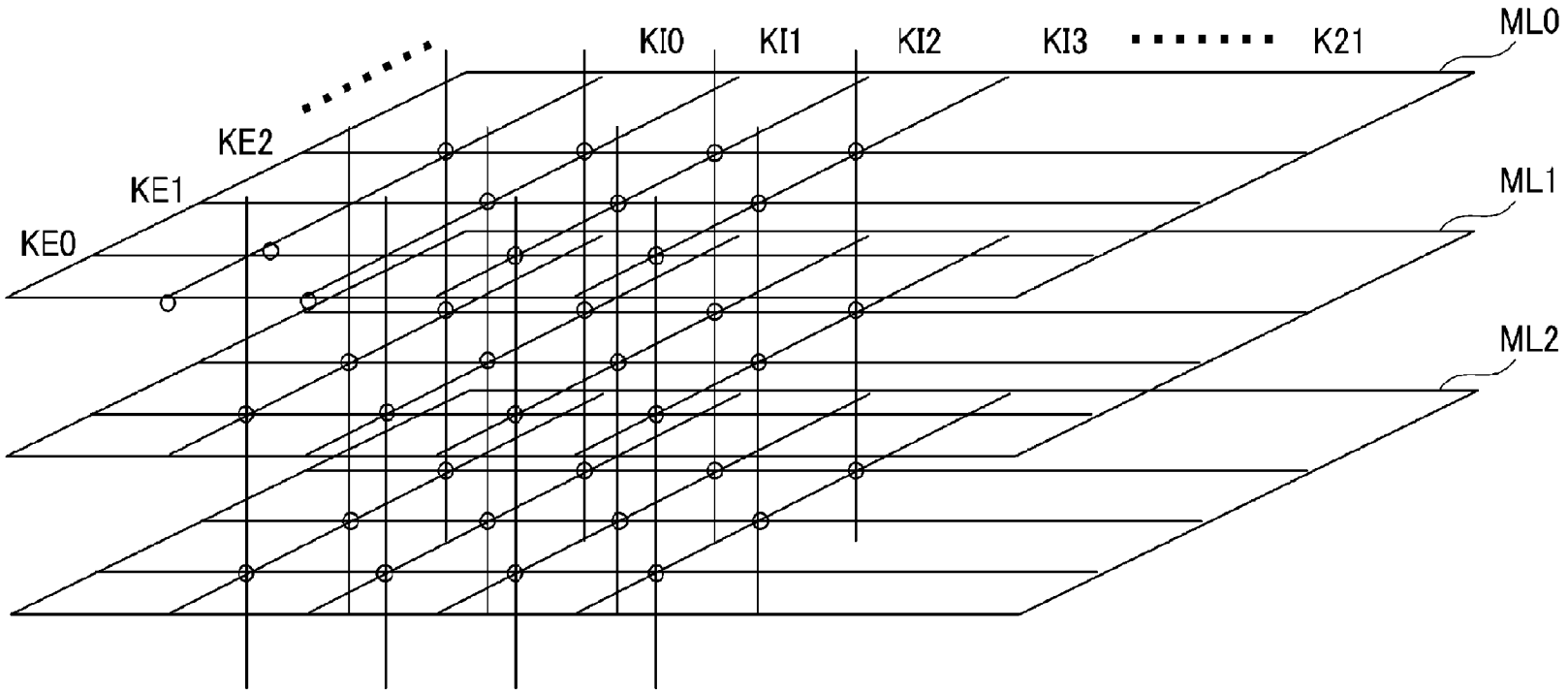
FIG. 2 is a conceptual diagram showing a switch matrix in a keyboard circuit of the keyboard device of FIG. 1.

FIG. 2 is a conceptual diagram showing a switch matrix in the keyboard circuit 15 (refer to FIG. 1) of the keyboard device 1 of the present embodiment.

The switch matrix in the keyboard circuit 15 is formed such that three layers of matrices ML0 to ML2 are laminated. For the matrix MLk of the $k^{th}$ layer (k is any one of the integers of 0 to 2), the 4 lines for scan output signals KE0 to KE3 and the 22 lines for input signals KI0 to KI21 are arranged so as to cross each other. In other words, it is possible to detect the ON/OFF states of 88 switches (22×4) for the $k^{th}$ matrix and it is possible to detect the ON/OFF states of 264 switches (88 (switches/layer)×3 (layers)) for the entire switch matrix).

Figure 3:
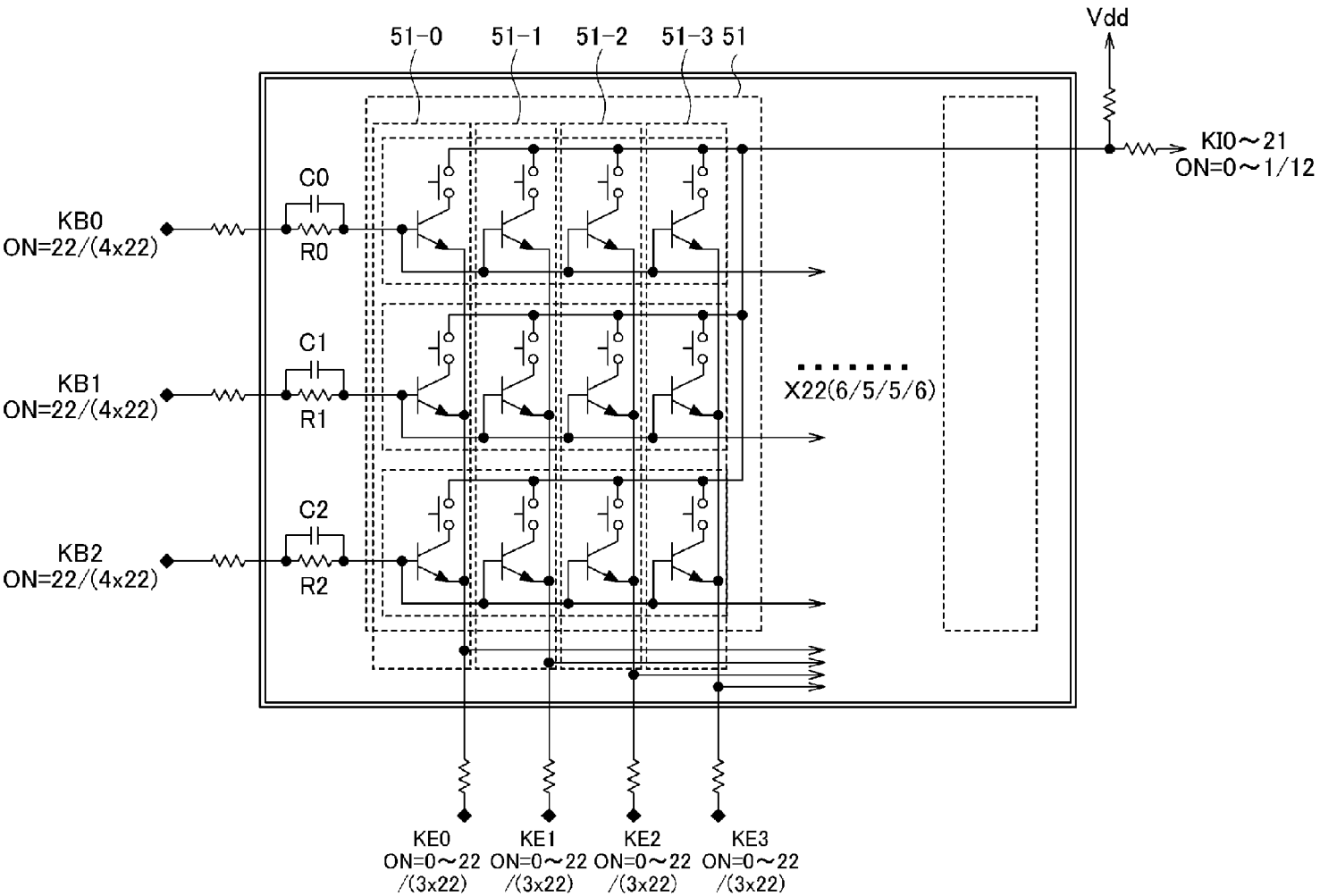
FIG. 3 is a view illustrating a configuration example of a switch matrix in a keyboard circuit of an electric music instrument of an embodiment.
Figure 4:
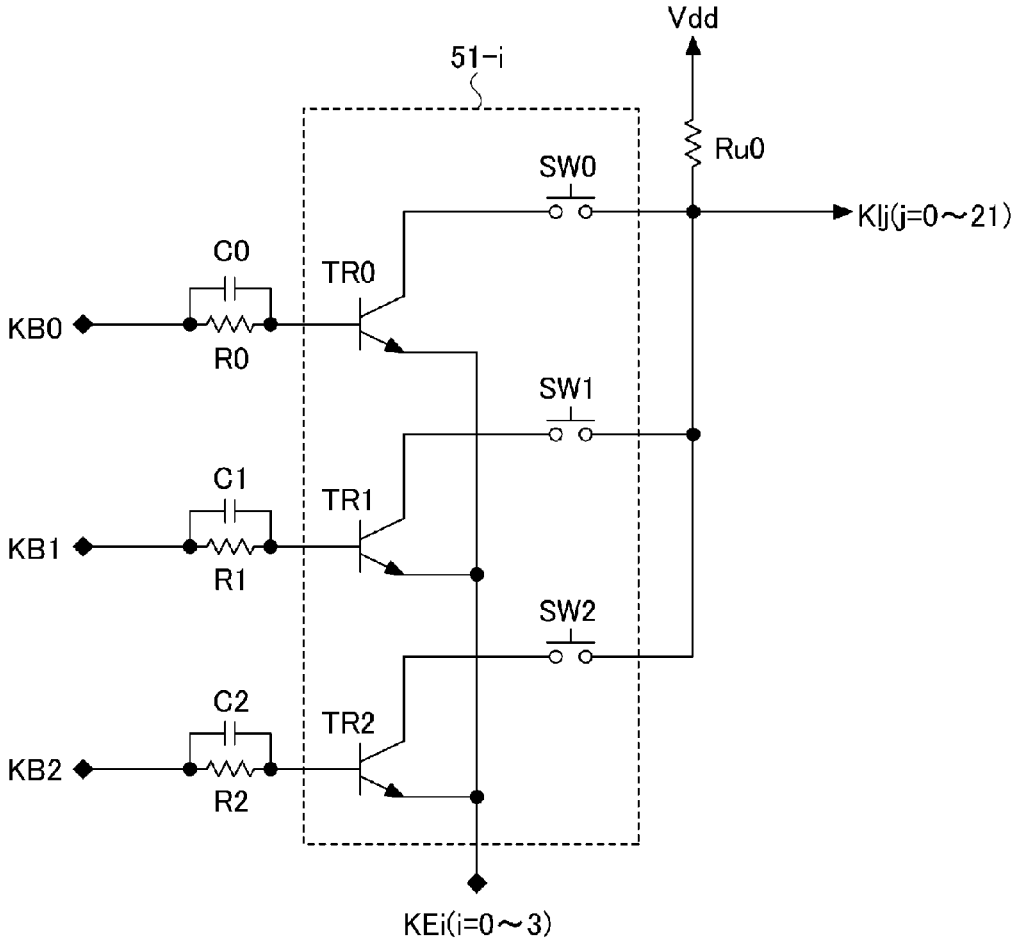
FIG. 4 is a view of a detailed configuration example illustrating a part of the keyboard circuit of FIG. 3 of the electric music instrument of an embodiment.
Figure 5:
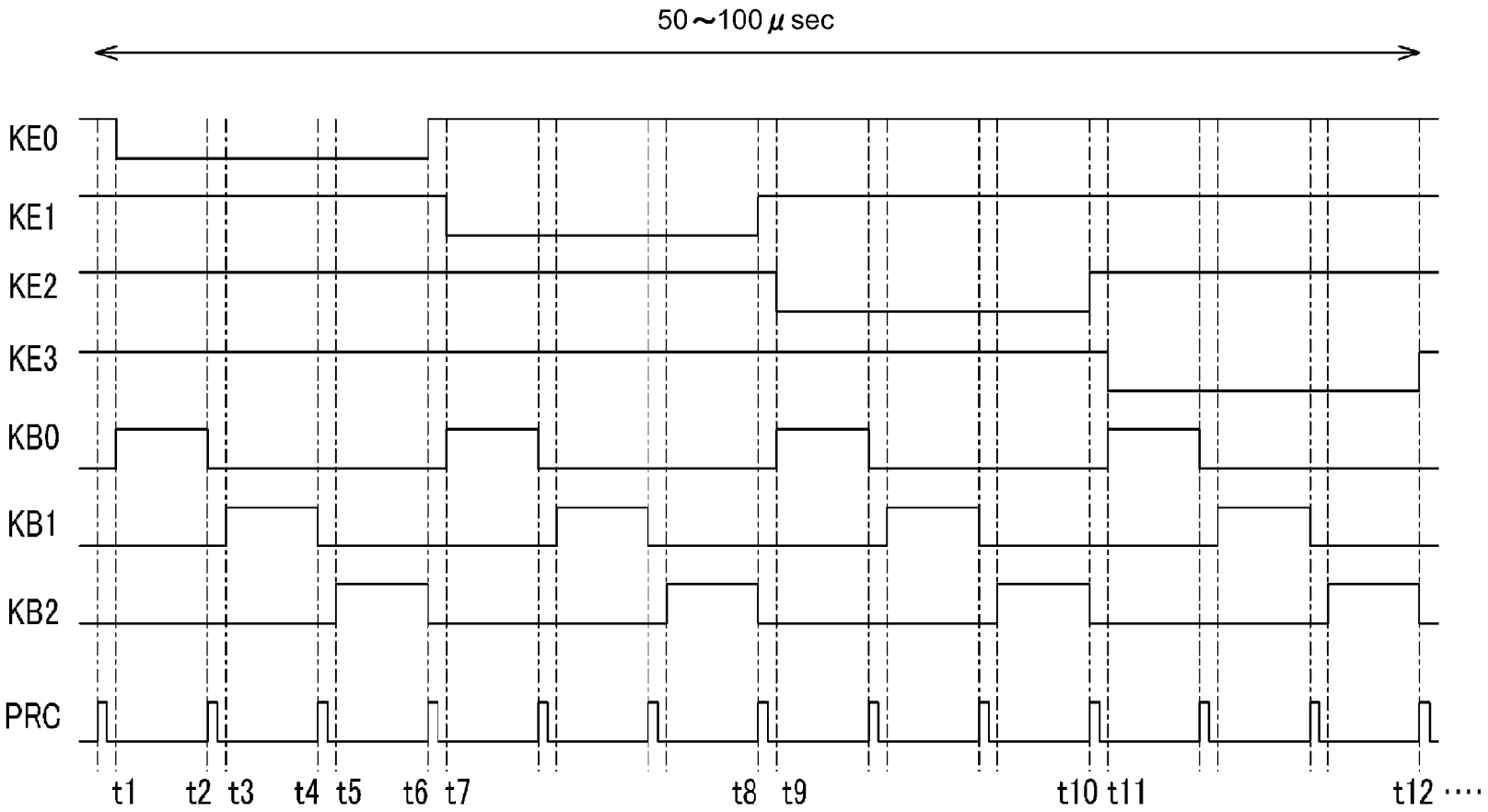
FIG. 5 provides timing charts illustrating an outline of operations of the switch matrix in the keyboard circuit of the embodiment shown in FIG. 3.

A layer to be activated among the three matrices ML0 to ML2 is selected and controlled by signals KB0 to KB2 as described later (FIGS. 3 to 5). While the detailed descriptions are made later with reference to FIGS. 3 to 5, signals KB0, KB1, and KB2 correspond to first, second and third contacts 14*a*, 14*b* and 14*c*, respectively. Furthermore, the matrix ML0 of the first layer, the matrix ML1 of the second layer, and the matrix ML2 of the third layer correspond to the first contact 14*a*, the second 14*b*, and the third contact 14*c*, respectively. Therefore, the activations/deactivations of the matrix ML0 of the first layer, the matrix ML1 of the second layer, and the matrix ML2 of the third layer are controlled by the signals KB0, KB1, and KB2, respectively.

Figure 9:
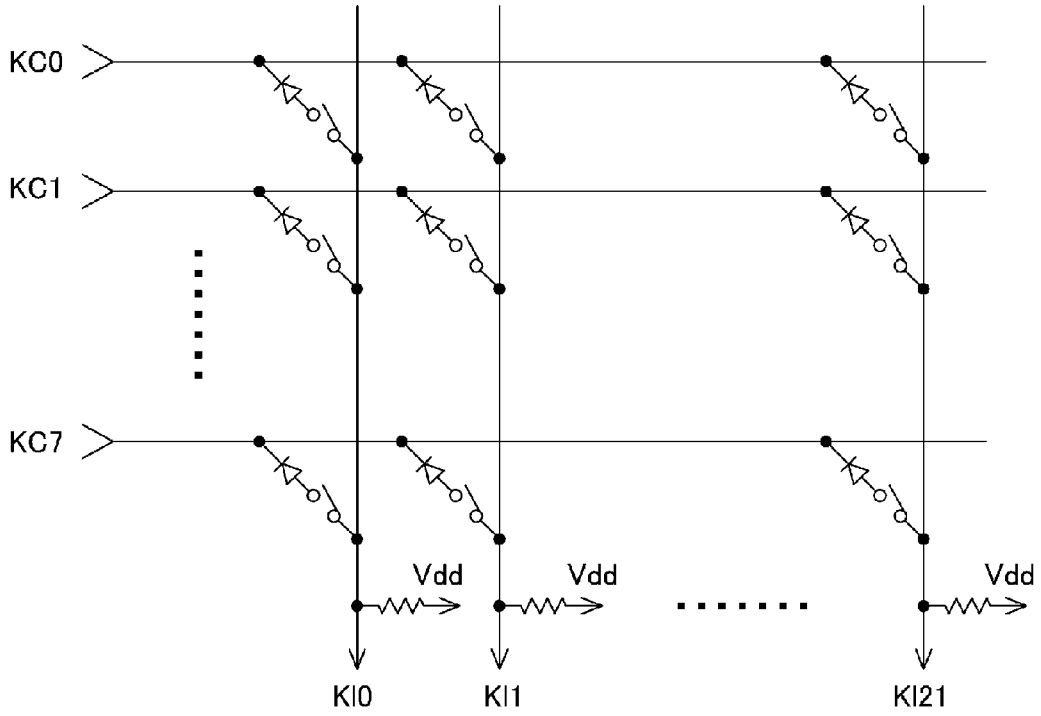
FIG. 9 is an equivalent circuit illustrating an outline of the configuration of a conventional switch matrix.
Figure 10:
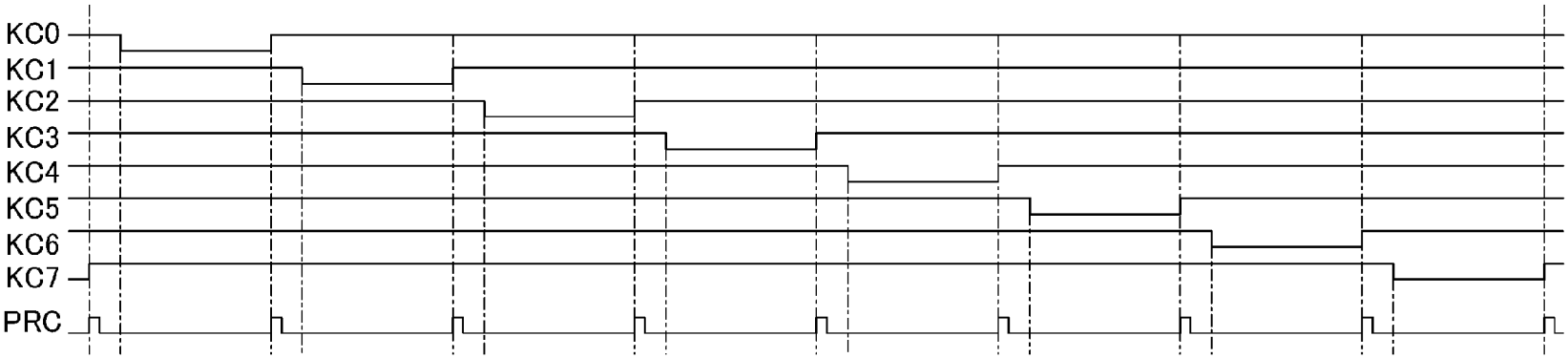
FIG. 10 is a view illustrating timing charts illustrating a summary of operations of a conventional switch matrix.

Here, two-dimensional switch matrix refers to a matrix formed with a single layer (matrix) on the keyboard circuit 15, as illustrated in FIG. 9. On the other hand, three-dimensional switch matrix refers to a matrix formed with more than one layer on the keyboard circuit 15, as illustrated in FIG. 2.

Next, a keyboard circuit 15 of an electric music instrument to which the switch matrix of FIG. 2 is mounted will be explained.

FIG. 3 is a view showing a configuration example of a switch matrix of the keyboard circuit 15 of the electric music instrument of the present embodiment.

FIG. 3 illustrates each switch of the matrices ML0 to ML2 of the three layers where the ON/OFF states are detected by the $j^{th}$ input signal KIj among the circuits having the three contacts for 88 keys constituting the switch matrices on the keyboard circuit 15 of the keyboard device 1 of FIG. 1.

In other words, a switch group 51 illustrated in FIG. 3 is configured with switch groups 51-0 to 51-3 where the ON/OFF states are detected by the $j^{th}$ input signal KIj. The switch group 51-0 is configured by three switches belonging to the matrices ML0 to ML2 of the three layers respectively for which the ON/OFF states are detected by the scan output signal KE0. The switch group 51-1 is configured by three switches belonging to the matrices ML0 to ML2 of the three layers respectively for which the ON/OFF states are detected by the scan output signal KE1. The switch group 51-2 is configured by three switches belonging to the matrices ML0 to ML2 of the three layers respectively for which the ON/OFF states are detected by the scan output signal KE2. The switch group 51-3 is configured by three switches belonging to the matrices ML0 to ML2 of the three layers respectively for which the ON/OFF states are detected by the scan output signal KE3.

In other words, since 22 input signals KI0 to KI21 exist in the present embodiment, the keyboard circuit 15 is practically configured by 22 switch groups 51.

Next, FIG. 4 shows a detailed configuration example of each switch of the matrices ML1 to ML3 of the three layers where the ON/OFF states are detected by the $j^{th}$ input signal KIj as well as the $i^{th}$ scan output signal KEi in the keyboard circuit 15 as illustrated in FIG. 3.

FIG. 4 is a detailed configuration example illustrating a part of the keyboard circuit 15 of FIG. 3 of the electric music instrument of the present embodiment.

Switches SW0 to SW2 respectively correspond to the first, second, and third contacts 14*a*, 14*b* and 14*c*, mounted to keys for which the ON/OFF states are detected by the $j^{th}$ input signal KIj as well as the $i^{th}$ scan output signal KEi.

A control signal KBk for activating a matrix MLk is provided to a base of a contact transistor TRk via a parallel connection of a speed-up capacitor Ck with a base resistor Rk. One terminal of the switch SWk is connected to a collector of the contact transistor contact TRk. The other terminal of the switch SWk is connected to a wire for the input signal KIj. For the wire for the input signal KIj, a power supply voltage Vdd is connected via the resistance Ru0. Furthermore, a wire for the scan output signal KEi is connected to an emitter of the contact transistor TRk.

Here, the operations of the switch groups 51-I are explained.

The transistor TRk operates exclusively with respect to other transistors, and thus it enters the ON state when the control signal KB0 is in the H level and the scan output signal KEj is in the L level. Therefore, so long as the switch SWk is in the ON state, the transistor TRk is in the NO state, and thus the input signal KIi is in the L level. On the other hand, in the case of the switch SWk being in the OFF state, the current does not flow via the transistor TRk, and thus the input signal KIi is in the H level.

In other words, the first contact 14*a* (switch SW0) mounted to keys, for which the ON/OFF states are detected by the $j^{th}$ input signal KIj as well as the $i^{th}$ scan output signal KEi, is detected as being in the ON state when the input signal KIi is in the L level, and is detected as being in the OFF state when the input signal KIi is in the H level in a case in which the scan output signal KEi is in the L level and the control signal KB0 is in the H level.

Similarly, the first contact 14*b* (switch SW1) mounted to keys for which the ON/OFF states are detected by the $j^{th}$ input signal KIj as well as the $i^{th}$ scan output signal KEi, is detected as being in the ON state when the input signal KIi is in the L level, and is detected as being in the OFF state when the input signal KIi is in the H level in a case in which the scan output signal KEi is in the L level and the control signal KB1 is in the H level.

The first contact 14*c* (switch SW2) mounted to keys for which the ON/OFF states are detected by the $j^{th}$ input signal KIj as well as the $i^{th}$ scan output signal KEi, is detected as being in the ON state when the input signal KIi is in the L level, and is detected as being in the OFF state when the input signal KIi is in the H level in a case in which the scan output signal KEi is in the L level and the control signal KB2 is in the H level.

Next, with reference to FIG. 5, the operations of the switch matrix of the keyboard circuit 15 illustrated in FIG. 3 are explained.

FIG. 5 provides timing charts showing an outline of the operations of the switch matrix in the keyboard circuit 15 of the present embodiment shown in FIG. 3.

FIG. 5 shows the timing charts of signals flowing for the scan output signals KE0 to KE3, the control signals KB0 to KB2, and the pre-charge signal PRC, respectively, in order from the top.

First, at the time t1, the scan output signal KE0 among the scan output signals KE0 to KE3 is only set to be in the L level and all of the remaining signals are set to be in the H level, and the control signal KB0 among the control signals KB0 to KB2 is only set to be in the H level and all of the remaining signals are set to be in the L level.

In this way, the 22 first contacts 14*a* respectively mounted to the keys where the ON/OFF states are detected by the input signals KI0 to KI21 and the scan output signal KE0 become the targets for detecting the ON/OFF states thereof. With respect to the input signal KIj, the switch SW0 in the switch group 51-*i* of FIG. 4 becomes the target for detecting the ON/OFF states.

In this case, as described above with reference to FIG. 4, among the input signals KI0 to KI21, the switch SW0 (first contact 14*a*) corresponding to a signal with the L level is detected as being in the ON state and the SW0 (first contact 14*a*) corresponding to a signal with the H level is detected as being in the OFF state.

Then, at the time t2, the control signal KB0 is switched from the H level to the L level, and at the time t3, the control signal KB1 is switched from the L level to the H level. In other words, at the time t3, only the scan output signal KE0 is set to be in the L level and the others are set to be in the H level among the scan output signals KE0 to KE3, and only the control signal KB0 is set to be in the H level and the others are set to be in the L level among the control signals KB0 to KB2.

In this way, the 22 second contacts 14*b* respectively mounted to the keys for which the ON/OFF states are detected by the input signals KI0 to KI21 and the scan output signal KE0 become the targets for detecting the ON/OFF states thereof. With respect to the input signal KIj, the switch SW0 in the switch group 51-*i* of FIG. 4 becomes the target for detecting the ON/OFF states.

In this case, as described above with reference to FIG. 4, among the input signals KI0 to KI21, the switch SW1 (second contact 14*b*) corresponding to a signal with the L level is detected as being in the ON state and the SW1 (second contact 14*b*) corresponding to a signal with the H level is detected as being in the OFF state.

Then, at the time t4, the control signal KB1 is switched from the H level to the L level, and at the time t5, the control signal KB2 is switched from the L level to the H level. In other words, at the time t5, only the scan output signal KE0 is set to be in the L level and the others are set to be in the H level among the scan output signals KE0 to KE3, and only the control signal KB2 is set to be in the H level and the others are set to be in the L level among the control signals KB0 to KB2.

In this way, the 22 third contacts 14*c* respectively mounted to the keys for which the ON/OFF states are detected by the input signals KI0 to KI21 and the scan output signal KE0 become the targets for detecting the ON/OFF states thereof.

With respect to the input signal KIj, the switch SW0 in the switch group 51-*i* of FIG. 4 becomes the target for detecting the ON/OFF states.

In this case, as described above with reference to FIG. 4, among the input signals KI0 to KI21, the switch SW2 (third contact 14*c*) corresponding to a signal with the L level is detected as being in the ON state and the SW2 (third contact 14*c*) corresponding to a signal with the H level is detected as being in the OFF state.

Then, at the time t6, the control signal KB2 is switched from the H level to the L level.

In this way, during the time t1 to time t6, only the scan output signal KE0 is set to be in the L level and the control signals KB0 to KB2 are sequentially set to be in the H level, respectively. In this way, the ON/OFF states are detected for the 22 first contacts 14*a* (switch SW0), the 22 second contacts 14*b* (switch SW1), the 22 third contacts 14*c* (switch SW2) respectively mounted to the keys where the ON/OFF states are detected by the input signals KI0 to KI21 and the scan output signal KE0, in this order.

Similarly, in the following, during the time t7 to time t8, only the scan output signal KE1 is set to be in the L level and the control signals KB0 to KB2 are sequentially set to be in the H level, respectively. In this way, the ON/OFF states are detected for the 22 first contacts 14*a* (switch SW0), the 22 second contacts 14*b* (switch SW1), the 22 third contacts 14*c* (switch SW2) respectively mounted to the keys for which the ON/OFF states are detected by the input signals KI0 to KI21 and the scan output signal KE1, in this order.

Then, during the time t9 to time t10, only the scan output signal KE2 is set to be in the L level and the control signals KB0 to KB2 are sequentially set to be in the H level, respectively. In this way, the ON/OFF states are detected for the 22 first contacts 14*a* (switch SW0), the 22 second contacts 14*b* (switch SW1), the 22 third contacts 14*c* (switch SW2) respectively mounted to the keys for which the ON/OFF states are detected by the input signals KI0 to KI21 and the scan output signal KE2, in this order.

Then, during the time t11 to time t12, only the scan output signal KE3 is set to be in the L level and the control signals KB0 to KB2 are sequentially set to be in the H level, respectively. In this way, the ON/OFF states are detected for the 22 first contacts 14*a* (switch SW0), the 22 second contacts 14*b* (switch SW1), the 22 third contacts 14*c* (switch SW2) respectively mounted to the keys for which the ON/OFF states are detected by the input signals KI0 to KI21 and the scan output signal KE3, in this order.

In this way, the ON/OFF states of the first contact 14*a* (switch SW0), the second contact 14*b* (switch SW1), and the 22 third contacts 14*c* (switch SW2) of all 88 keys of the electric music instrument are detected during the time t1 to time t12.

In addition, it should be noted that, since the repetition cycle of the scan output signals KE0 to KE2 is designed so as to cycle at approximately 50 to 100 micro seconds, the resolution for detecting a key speed is 50 to 100 micro seconds.

Furthermore, the pre-charge signal PRC is employed in a similar use to the conventional use as described with reference to FIG. 9. In other words, the pre-charge signal PRC accelerates the rise of the input signals KI0 to KI21 for high speed scan. By supplying this pre-charge signal PRC, it is possible to accelerate the rise characteristic without returning the input signal KI side to the H level by means of pull-up.

As described above, by applying the three-dimensional switch matrix, it becomes possible to detect the three contacts 14*a*, 14*b*, and 14*c* with a number of wires numbers equivalent to the conventional switch matrix for detecting two contacts (two-dimensional switch matrix). Therefore, it is possible to realize the keyboard circuit 15, i.e. a three-contact detection circuit, of the present embodiment with a conventional substrate size and a single-sided substrate. Since transistors are mounted in place of conventional diodes for the matrix, this increases the costs. However, since semiconductor components cost less for material and thus are efficient in mass production, a reduction in unit price can be expected by using large quantity of semiconductor components. In the current situation, since the amount of the cost increase is sufficiently low compared to the cost increase in unit price by adopting a double-sided substrate, it is possible to improve the cost-effectiveness of the present invention.

Next, an example of a technique for detecting the ON/OFF state of a switch of each key based on input signals KI0 to KI2 from a switch matrix is explained with reference to FIG. 6.

Figure 6:
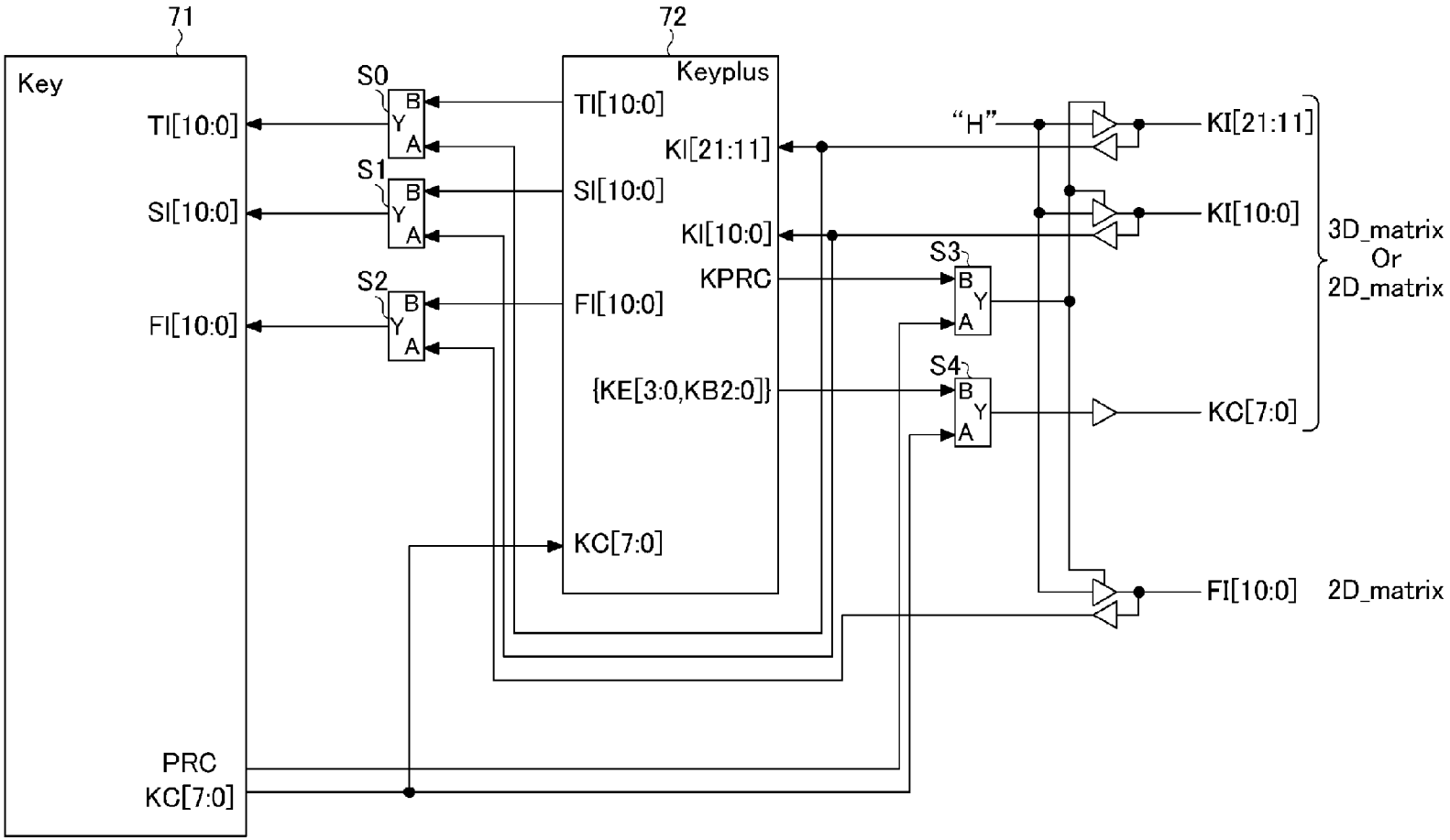
FIG. 6 is a view illustrating a configuration example other than a switch matrix of a keyboard circuit of an electric music instrument of an embodiment.

FIG. 6 is a diagram showing a configuration example of the keyboard circuit 15 of the electric music instrument of the present embodiment, other than a switch matrix.

In regards to the structure of matrix and operation timing, a keyboard circuit for detecting three contacts adopting a two-dimensional switch matrix completely differs from the keyboard circuit for detecting three contacts adopting a three-dimensional switch matrix (FIGS. 3 and 4). A keyboard circuit for detecting three contacts adopting a two-dimensional switch matrix does not refer to the conventional circuit of FIG. 9 explained in Background of the Invention, but rather to a keyboard circuit having 264 switches (88 (keys)×3 (contacts/key) (not illustrated).

Therefore, the keyboard circuit adopting a three-dimensional switch matrix cannot adopt a circuit for a two-dimensional switch matrix, for example, a circuit for detecting the ON/OFF state of a key or calculating a speed, basically as it is, and thus is redesigned.

However, for convenience upon producing a keyboard circuit, it is preferable to realize a keyboard circuit compatible with both a keyboard adopting a two-dimensional switch matrix and a keyboard adopting a three-dimensional switch matrix. In other words, it is desirable to be compatible with both the old and new types of keyboards for a keyboard circuit mounted to an LSI (Large Scale Integration).

Therefore, the keyboard circuit 15 of the present embodiment has a configuration compatible with both a keyboard adopting a conventional two-dimensional switch matrix and a new keyboard adopting a three-dimensional switch matrix by simply adjusting the terminals.

In addition to the abovementioned three-dimensional switch matrix of FIG. 3 or the conventional two-dimensional switch matrix, the keyboard circuit 15 of the electric music instrument as illustrated in FIG. 6 includes a Key block 71, a Keyplus block 72, and a plurality of selectors S (herein, five selectors S0 to S4).

The Key block 71 and the Keyplus block 72 are connected via the plurality of selectors S0 to S4.

The selector Sm (m is any integer of 0 to 4) includes two input terminals A and B and one output terminal Y.

At the selector Sm, the input terminal A is selected in a case in which a conventional keyboard adopting a two-dimensional switch matrix is selected and the input terminal B is selected in a case in which a conventional keyboard adopting a three-dimensional switch matrix is selected, and a signal inputted to the input terminal A or B is outputted from the output terminal Y.

By preparing a plurality of such selectors Sm (herein, five selectors) and arranging appropriately, it can be adapted to both a new keyboard adopting a three-dimensional switch matrix and a conventional keyboard adopting a two-dimensional switch matrix.

The Key block 71 is a circuit that inputs the three signals of the signal FI[10:0], SI[10:0], and TI[10:0] to detect the ON/OFF states of three contacts of each key, and is configured as a circuit for detecting a contact that is applied to a two-dimensional switch matrix.

Among the input signals inputted to the Key block 71, the signal FI[10:0] is an input signal indicating a state of the first contact 14*a*, the signal SI[10:0] is an input signal indicating a state of the second contact 14*b*, and the signal TI[10:0] is an input signal indicating a state of the third contact 14*c*.

Here, a numerical value in brackets represents the number of wires for a signal arranged in the switch matrix in the keyboard circuit 15. More specifically, for example, the signal FI[10:0] represents a case of the number of wires of the first contact 14*a* arranged in the switch matrix in the keyboard circuit 15 being 10. Similarly, the signal SI[10:0] represents a case of the number of wires of the second contact 14*b* arranged in the switch matrix in the keyboard circuit 15 being 10. Similarly, the signal TI[10:0] represents a case of the number of wires of the second contact 14*c* arranged in the switch matrix in the keyboard circuit 15 being 10.

Furthermore, among the signals outputted from the Key block 71, the signal PRC represent a pre-charge signal and the signal KC[7:0] represents a scan output signal.

In a case in which a keyboard adopting a two-dimensional switch matrix is selected at the selectors S0 to S4, the scan output signal KC[7:0] outputted from the Key block 71 is outputted to the two-dimensional switch matrix (2D_matrix). Since the input signals KI[10:0], KI[21:11], and FI[10:0] from the two-dimensional switch matrix (2D_matrix) are inputted directly to the Key block 71, the detection circuit for the two-dimensional switch matrix functions as it is and it is possible to detect the ON/OFF state of a key or a key speed. Here, the input signals KI[10:0], [21:11] correspond to the input signals KI0 to KI21 of the conventional two-dimensional switch matrix for two contacts as illustrated in FIG. 9. Although the two-dimensional switch matrix uses a two-contact circuit, a three-contact circuit is used here. Therefore, the input signal FI[10:0] is a signal that is added since the number of switches as a target for detection increases by this amount.

The KeyPlus block 72 represents a new three-contact circuit adopting a three-dimensional switch matrix.

The KeyPlus block 72 divides a basic block and generates and outputs the scan output signal KE[3:0], the control signal KB[2:0], and the pre-charge signal KPRC (PRC in FIG. 5), respectively, among the signals illustrated in the timing charts of FIG. 5, for example. Then, the Keyplus block 72 acquires the input signals KI[21:11] and KI[10:0] from the three-dimensional switch matrix (3D_matrix).

The KeyPlus block 72 stores the input signals KI[21:11: and KI[10:0] thus acquired, i.e. switch states to store in the register, and outputs the switch states corresponding to the scan output signal KE[3:0] and the control signal KB[2:0] (refer to FIG. 8 for the corresponding relationships) to the Key block 71 as the input signal FI[10:0], the input signal SI[10:0], or the input signal TI[10:0]. In this way, even at the time of connecting a new keyboard adopting a three-dimensional switch matrix, detection can be performed through the Key block 71, which is a detection circuit originally for a two-dimensional switch matrix.

Next, the corresponding relationships between switches as a target for detection within a three-dimensional switch matrix (3D_matrix) and the scan output signal KE[3:0], the control signal KB[2:0], and the input signal KI[21:0] are explained with reference to FIG. 7.

FIG. 7 is a view illustrating the corresponding relationships between states of switches as a target for detection within a three-dimensional switch matrix (3D_matrix) and the scan output signal KE[3:0], the control signal KB[2:0], and the input signal KI[21:0], as illustrated in FIG. 6.

A state Fm ($0 \le m \le 87$) represents a state of the first contact 14*a* (switch SW0 in FIG. 4) of the $m+1^{th}$ key, Sm represents a state of the second contact 14*b* of the $m+1^{th}$ key, and a state Tm represents a state of the third contact 14*c* of the $m+1^{th}$ key. The information indicating the states of these contacts 14*a*, 14*b*, and 14*c* is acquired by the Keyplus block 72 and stored in an area of the register, and outputted to the Key block 71 as the input signal FI[10:0], the input signal SI[10:0], or the input signal TI[10:0].

Next, the corresponding relationships between switches as a target for detection within a two-dimensional switch matrix (2D_matrix) and the scan output signal KC[7:0] and the input signals FI[10:0], SI[10:0], and TI[10:0] are explained with reference to FIG. 8.

FIG. 8 is a view illustrating relationships of states of switches as a target for detection within a two-dimensional switch matrix (2D_matrix) specified based on the scan output signal KC[7:0] and the input signals FI[10:0], SI[10:0], and TI[10:0], as illustrated in FIG. 6.

A state Fp ($0 \le p \le 87$) represents a state of the first contact 14*a* of the $p+1^{th}$ key, a state Sp ($0 \le q \le 87$) represents a state of the second contact 14*b* of the $p+1^{th}$ key, and a state Tp represents a state of the third contact 14*c* of the $p+1^{th}$ key.

The Keyplus block 72 scans a switch state after passing through the Keyplus block 72 once in the Key block 71, by outputting a switch state corresponding to FIG. 8 in response to the scan output signal KC[7:0] that is inputted from the Key block 71. Therefore, the keyboard circuit for a two-dimensional switch matrix can not only be used as is, but further, connection to the two-dimensional switch matrix also becomes possible. In addition, it should be noted that, so as not to degrade a detection accuracy of key speed, it is also possible to operate the Keyplus block 72 by establishing the scan output signal KC[7:0] specifying a processing cycle of a detection circuit for a two-dimensional switch matrix as a synchronization signal. However, even in such a case, since the resolution for measuring a key speed is small at 50 to 100 microseconds, it can be considered that there is no significant influence thereon.

As described above, the keyboard circuit 15 of the electric music instrument includes contact transistors TRk having at least three terminals as input/output terminals for state detection for each of a plurality of contacts 14*a*, 14*b*, and 14*c*; and wiring units to the contact transistors TRk and the contacts 14*a*, 14*b*, and 14*c*. Contact transistors TRk and the wiring unit for each of the plurality of contacts 14*a*, 14*b*, and 14*c* are arranged to be divided into a plurality of layers in three dimensions. Then, the keyboard circuit 15 detects ON/OFF states for each of the contacts 14*a*, 14*b*, and 14*c* for which the ON/OFF states change in response to a key-pressing operation for each of a plurality of keys 12 and for which at least one is provided to each of the plurality of keys 12.

In this way, by configuring the wires forming a plurality of control signal groups to be divided into a plurality of layers in three dimensions, it becomes possible to detect the three contacts 14*a*, 14*b*, and 14*c* with a number of wires equivalent to the conventional switch matrix for detecting two contacts. Therefore, wiring become possible with a conventional substrate size, and thus a circuit detecting three contacts can be formed even with an inexpensive single-sided substrate.

Therefore, it is possible to provide a keyboard circuit of an electric music instrument that can significantly reduce the number of wires of a keyboard switch substrate compared to conventional ones, and thus can be wired on a single-side substrate.

Furthermore, M number of kinds of the contact units 14*a*, 14*b*, 14*c* are provided for N number of keys. the contact transistors TRk are provided with three terminals as input/output terminals; among the three terminals of the contact transistors TRk, a control signal KBk that specifies the kind of the contact units as a target for detection from among the M number of kinds is supplied to a first terminal, a scan output signal KEi that specifies a key having the contact units as a target for detection from among the N number of keys is supplied to a second terminal, and the contact units 14*a*, 14*b*, and 14*c* are connected to a third terminal; and the ON/OFF states of N×M number of the contact units 14*a*, 14*b*, and 14*c* are detected based on a combination of states of M number of kinds of the control signal KBk, states of P number of kinds of the scan output signal KEi, and {(N×M)/(M×P)} number of kinds of input signals KIi supplied to the third terminal through the elements.

By realizing the matrix structure in which two outputs/one input is arranged in three dimensions in this way, instead of the conventional matrix structure in which one output/one input is arranged in two dimensions, it is possible to provide an efficient switch matrix with a fewer number of wires.

Therefore, since 1.5 times the number of switches can be scanned with the number of wires equivalent to that of the conventional switch matrix, it is possible to realize a switch substrate having a strict space limitation such as the keyboard of an electric piano with a size and cost equivalent to the conventional substrates.

Furthermore, the contact transistors TRk provided for each of the plurality of contact units 14*a*, 14*b*, 14*c* are transistors that can control two inputs.

In the present embodiment, by adopting a transistor in place of the diode of a two dimensional matrix in order to realize the matrix structure in which two outputs/one input is arranged in three dimensions, instead of the conventional matrix structure in which one output/one input is arranged in two dimensions, it is configured so that a switch connected this transistor is scanned by the two-input control of the transistor.

In this way, it is possible to provide an efficient switch matrix with a fewer number of wires.

Furthermore, although the keyboard device 1 to which the present invention is applied is explained with an example of an electric piano in the abovementioned embodiment, the present invention is not limited thereto.

For example, the present invention generally can be applied to an electric keyboard device having a keyboard. Specifically, the present invention can be applied to, for example, a keyboard device such as an electric organ and a harpsichord.

Furthermore, although transistors are adopted in the abovementioned embodiment, the present invention is not limited thereto. For example, similar matrix can be configured by mounting an IC having equivalent functions in place of transistors; however, it is considered to be suitable as of this moment to adopt transistors that are practical in terms of mounting space and cost.

Furthermore, in the abovementioned embodiment, it is configured so as to scan the state of a new matrix, and then convert to the format of a conventional matrix, thereby allowing to be connected to a conventional circuit for detecting states of ON/OFF and key speed. Therefore, it is possible to connect to both a conventional keyboard and a new keyboard by way of a switching circuit.

The above-described series of processes can be performed by hardware or can be performed by software.

When a series of processes are performed by software, a program constituting the software is installed on a computer, etc., via a network or from a recording medium.

The computer may be a computer incorporated in dedicated hardware. Alternatively, the computer may be a computer capable of performing various functions by installing various programs, e.g., a general-purpose personal computer.

A recording medium including such a program is not only configured by the removable medium which is distributed separately from the apparatus main body in order to provide a user with the program, but is also configured by, for example, a recording medium which is provided to the user, incorporated in advance in the apparatus main body. The removable medium is configured by, for example, a magnetic disk (including a floppy disk), an optical disk, a magneto-optical disk, or the like. The optical disk may be configured by, for example, a CD-ROM (Compact Disk-Read Only Memory), a DVD (Digital Versatile Disk), or the like. The magneto-optical disk is configured by an MD (Mini-Disk) or the like. The recording medium which is provided to the user, incorporated in advance in the apparatus main body is configured by, for example, the ROM 12 in FIG. 1 having a program recorded therein, a hard disk included in the storage unit 21 in FIG. 1, or the like.

Note that in the specification the steps describing a program recorded in a recording medium not only include processes that are performed in the order of the steps in a time-series manner, but also include processes that are not necessarily processed in a time-series manner but are performed in parallel or individually.

Although the embodiment of the present invention has been described above, the embodiment is merely illustrative and do not limit the technical scope of the present invention. The present invention can employ various other embodiments, and furthermore, various changes such as omission and replacement may be made therein without departing from the true spirit of the present invention. These embodiments and modifications thereto are included in the true scope and spirit of the present invention described in the specification, etc., and are included in the inventions described in the appended claims and in the range of equivalency of the inventions.

What is claimed is:

1. A keyboard circuit comprising:

contact units that are provided so as to correspond to a plurality of keys, respectively, the contact units having ON/OFF states that change in response to a key-pressing/key-releasing operation to the plurality of keys;

elements that are provided for each of the plurality of contact units, wherein each of the elements has at least three input/output terminals and the contact units are connected to any one of the input/output terminals; and a wiring unit that outputs signals indicating the ON/OFF states of the respective contact units by supplying a switch signal to a remaining one of the input/output terminals of the respective elements, supplying a control signal to another remaining one of the input/output terminals, and supplying to the contact units the switch signal supplied in a time-division manner by way of the control signal.

2. The keyboard circuit according to claim 1, wherein the elements provided for each of the plurality of contact units are transistors that can control two inputs.

3. The keyboard circuit according to claim 1, wherein:

M number of kinds of the contact units are provided for N number of keys;

the elements are provided with three terminals as input/output terminals;

among the three terminals of the elements, a first control signal that specifies the kind of the contact units as a target for detection from among the M number of kinds is supplied to a first terminal, a second control signal that specifies a key having the contact units as a target for detection from among the N number of keys is supplied to a second terminal, and the contact units are connected to a third terminal; and the ON/OFF states of N×M number of the contact units are detected based on a combination of states of M number of kinds of the first control signal, states of P number of kinds of the second control signal, and {(N×M)/(M×P)} number of kinds of scan signals supplied to the third terminal through the elements.

4. The keyboard circuit according to claim 3, wherein the elements provided for each of the plurality of contact units are transistors that can control two inputs.

5. A method for detecting a keyboard circuit, the keyboard circuit including Ill contact units that are provided so as to correspond to a plurality of keys, respectively, the contact units having ON/OFF states that change in response to a key-pressing/key-releasing operation to the plurality of keys, and (ii) elements that are provided for each of the plurality of contact units, each of the elements having at least three input/output terminals and the contact units being connected to any one of the input/output terminals, the method comprising:

inputting a switch signal to a remaining one of the input/output terminals of each of the elements;

inputting a control signal to another remaining one of the input/output terminals; and outputting a signal indicating the ON/OFF states of the respective contact units by supplying to the contact units the switch signal inputted in a time-division manner by way of the control signal.

6. The method according to claim 5, wherein the elements provided for each of the plurality of contact units are transistors that can control two inputs.

7. The method according to claim 5, wherein:

M number of kinds of the contact units are provided for N number of keys;

the elements are provided with three terminals as input/output terminals;

among the three terminals of the elements, a first control signal that specifies the kind of the contact units as a target for detection from among the M number of kinds is supplied to a first terminal, a second control signal that specifies a key having the contact units as a target for detection from among the N number of keys is supplied to a second terminal, and the contact units are connected to a third terminal; and the ON/OFF states of N×M number of the contact units are detected based on a combination of states of M number of kinds of the first control signal, states of P number of kinds of the second control signal, and {(N×M)/(M×P)} number of kinds of scan signals supplied to the third terminal through the elements.

8. The method according to claim 7, wherein the elements provided for each of the plurality of contact units are transistors that can control two inputs.

* * * * *

UNITED STATES PATENT AND TRADEMARK OFFICE

CERTIFICATE OF CORRECTION

PATENT NO. : 8,927,848 B2
APPLICATION NO. : 13/919946
DATED : January 6, 2015
INVENTOR(S) : Yoji Kaneko et al.

It is certified that error appears in the above-identified patent and that said Letters Patent is hereby corrected as shown below:

In the Claims

Column 15, Claim 5, Line 27, delete "|11" and insert --(i)--.

Signed and Sealed this
Fourteenth Day of July, 2015

Michelle K. Lee

Michelle K. Lee
*Director of the United States Patent and Trademark Office*